United States Patent [19]

Maguire

[11] Patent Number: 4,509,654

[45] Date of Patent: Apr. 9, 1985

[54] TAMPERPROOF CLOSURE

[76] Inventor: Daniel J. Maguire, P.O. Box 113, Flourtown, Pa. 19031

[21] Appl. No.: 632,954

[22] Filed: Jul. 20, 1984

Related U.S. Application Data

[62] Division of Ser. No. 478,209, Mar. 24, 1983.

[51] Int. Cl.[3] ..... B65D 41/48

[52] U.S. Cl. ..... 215/253; 215/258

[58] Field of Search ..... 215/256, 253, 258; 220/276, 270

[56] References Cited

U.S. PATENT DOCUMENTS 3,622,028 11/1971 Lohrer ..... 215/253

4,362,253 12/1982 Wortley et al. ..... 215/253 X

*Primary Examiner*—Donald F. Norton

*Attorney, Agent, or Firm*—Steele, Gould & Fried

[57] ABSTRACT

A tamperproof closure is disclosed for use with a container nozzle having a circular transfer bead. The closure includes a top and depending sidewalls which are defined from a bottom extension by a circular weakened seam. An interior groove is provided in the bottom extension of diameter less than the diameter of the transfer bead. A plurality of slots are formed in the bottom extension between the weakened seam and the interior groove to provide a degree of flexibility. The closure may be applied to the nozzle in either a threaded connection or in a snap ring connection. Upon opening the container, the frictional engagement between the transfer bead and the interior groove will cause the bottom extension to remain tightly affixed to the transfer bead, thereby causing the closure to sever along the weakened seam.

7 Claims, 10 Drawing Figures

FIG. 1
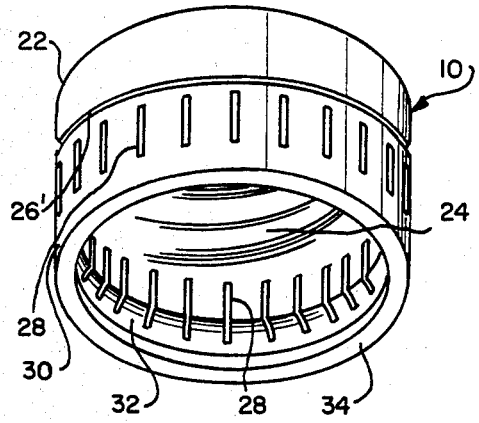
FIG. 2
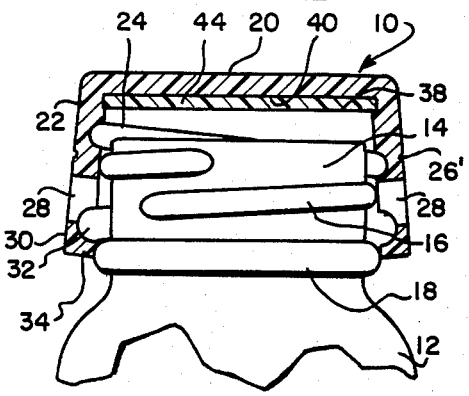
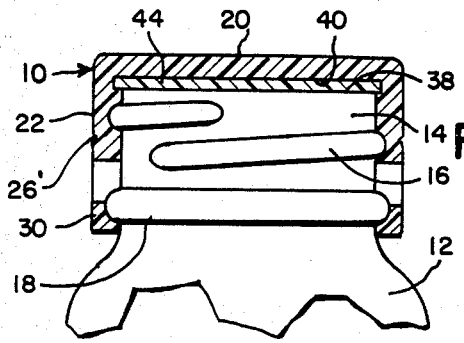
FIG. 3
FIG. 4
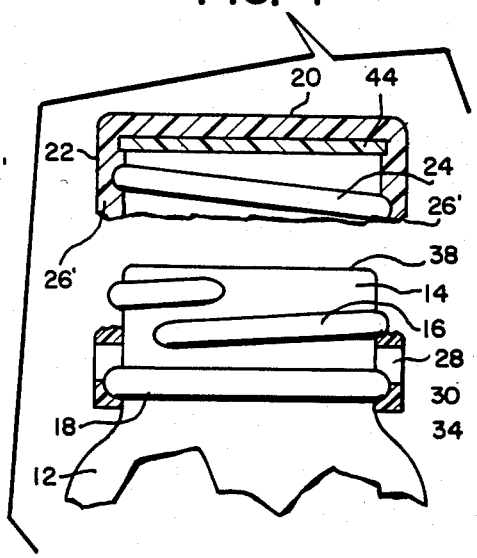
FIG. 5
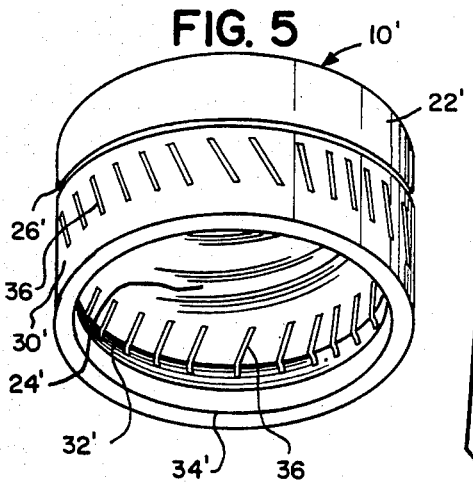

FIG. 9
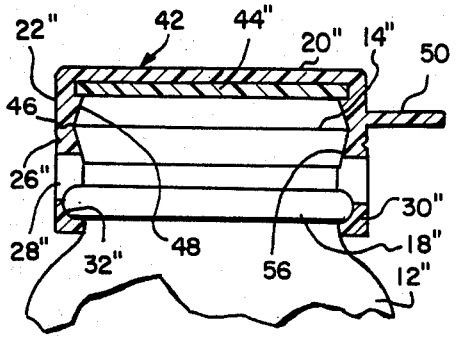
FIG. 6
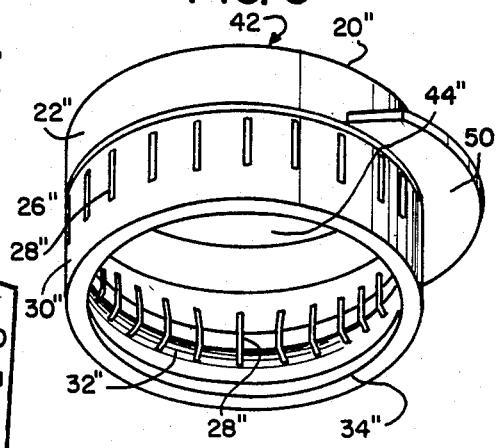
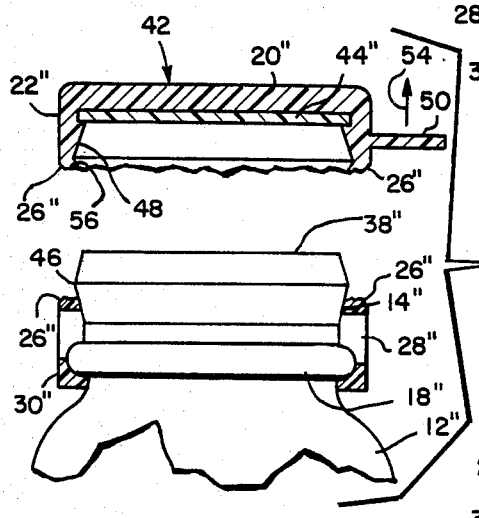
FIG. 10
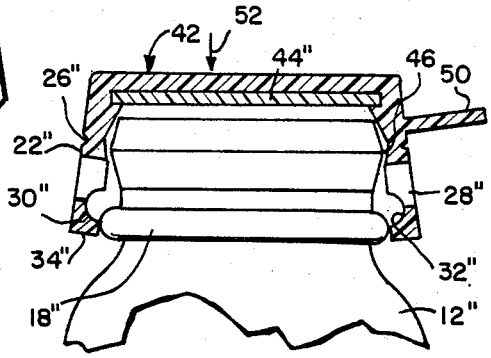
FIG. 8
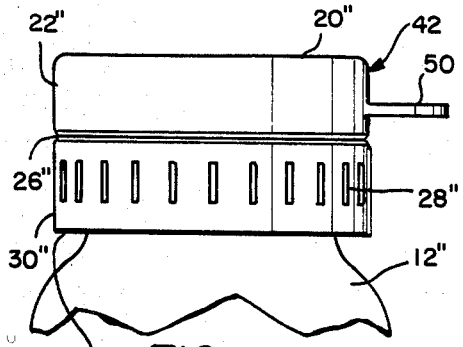
FIG. 7

TAMPERPROOF CLOSURE

This is a division of application Ser. No. 478,209, filed Mar. 24, 1983.

FIELD OF INVENTION

The present invention relates generally to the field of bottle closures, and more particularly, relates to a tamperproof closure suitable for use with both threaded and non-threaded container nozzles.

BACKGROUND OF THE INVENTION

Various types of container closures have been developed and utilized by prior workers in the art. Simple closures such as threaded closures and snap-on closures have long been popular and have been in general use both in this country and in many other countries throughout the world. More recently, the need has arisen to develop more sophisticated container closures to guard against particular problems. For example, it has been found necessary to provide child-proof closures for certain types of medicines and other products which could be harmful to children to guard against the event that a child might be in a position to open the container during some unsupervised period. More recently, tamperproof closures have proved to be necessary to prevent unauthorized tampering with the contents of a container prior to use by anyone, child and adult alike.

Numerous attempts have been made in the field of tamperproof or child-proof container closures to develop suitable replaceable caps or closures for bottles containing medicines. In non-medicinal storage containers, it has long been known to use non-replaceable cap closures. Such closures have widely been employed in connection with soft drink bottles and beverage cans which are exemplary of this type of closure.

Previous attempts to design tamperproof closures have generally been directed to a type of closure which will be deformed or destroyed upon opening and such closures have been developed in an effort to prohibit tampering with the stored materials in the associated containers without being readily observable. However, the attempts of prior workers in the art in connection with tamperproof closures have generally resulted in a single service type of construction wherein the closure was not reusable to again close the container once the tamperproof construction has been disturbed. Despite all of the prior efforts of the workers in this field, the need remains to provide a simply constructed, inexpensive, and reusable tamperproof closure remains.

SUMMARY OF THE INVENTION

The present invention relates generally to the field of container closures, and more particularly, is directed to a reusable type of tamperproof container closure.

The closure of the present invention is designed in one configuration for use with a threaded container nozzle. In a modified construction the closure may be employed for use with a snap-on type of container nozzle. In the threaded configuration, the closure comprises generally a closure top having cylindrical sidewalls integrally depending therefrom. A hollow cylindrical bottom extension is defined from the closure sidewalls by a weakened seam and is designed to always remain affixed to the container nozzle once the closure has been applied to the container.

The closure sidewalls and bottom extension are provided with a continuous, interior thread of size and pitch to threadedly engage the external threads formed in the container nozzle. The closure threads terminate bottomly in peripheral groove, which groove is designed for cooperative engagement with a circular transfer bead which is conventionally provided at the bottom of the container nozzle. It is of utmost importance that the outer diameter of the nozzle bottom groove be smaller than the outer diameter of the nozzle transfer bead whereby once the closure bottom groove has been applied over the nozzle transfer bead, a frictional engagement therebetween will always prevent removal of the closure bottom extension from the container nozzle during the container opening procedure.

The closure bottom extension is provided with a plurality of circularly spaced either longitudinally aligned or slanted slots which extend from below the weakened seam to the top of the bottom circular groove. The slots are intended to deform slightly during the closure application process to thereby enable the closure bottom groove to be applied over the nozzle transfer bead even though the transfer bead, as above set forth has an outer diameter that is larger than the outer diameter of the bottom groove.

Once the closure has been threadedly engaged over the threads of the nozzle and the closure groove has been fully seated over and frictionally engaged upon the nozzle transfer bead, the frictional engagement forces set up between the transfer bead and the closure bottom groove will prevent the unscrewing the closure relative to the nozzle without permanent damage.

The circular weakened seam is provided above the plurality of slots to provide a weakened area whereby the closure sidewall will be separated from the closure bottom extension when the container is opened by unthreading the closure relative to the container nozzle. Thus, once the closure has been properly applied over the container nozzle, it is impossible to gain access to the container contents without permanently damaging the closure along the weakened seam thereof, thereby giving ready visible evidence of any tampering with the container contents.

After the container has been opened legitimately, and it is again desired to close the container, the closure side wall has been designed to contain sufficient threads to threadedly engage the upper portions of the nozzle threads to thereby again threadedly engage the closure with the nozzle. In this manner, the container can be reclosed, even though the closure had been separated along the weakened seam.

In another embodiment of the invention, a snap-on type of closure has been designed to provide a snap-on, frictional engagement between the closure and the container nozzle.

In the snap-on embodiment, the closure is similarly provided with a top and integrally depending cylindrical side walls, which sidewalls terminate downwardly in a weakened seam. The weakened seam defines a similar bottom extension from the closure sidewalls in a manner to permit removal of the closure top and side walls from the container nozzle by breaking along the weakened seam. In this embodiment also, the bottom extension will remain associated with the nozzle transfer bead after the container has been opened.

The interior of the closure is formed for snap-on frictional engagement with the container nozzle to prevent leakage thereabout. The bottom interior periphery of the bottom extension is formed with an internal groove of diameter smaller than the outer diameter of the container transfer bead which is positioned at the base of the nozzle. Accordingly, when the closure is snapped over the container nozzle, the interior groove will tightly, frictionally engage the transfer bead so as not to be easily removed therefrom. The differences in diameter and the frictional engagement of the closure bottom extension on the transfer bead provides a tamper-proof arrangement of the parts at the transfer bead by requiring an actual breaking of the closure to gain access to the container interior. A plurality of longitudinally aligned or slanted, circularly spaced slots are formed in the closure bottom extension from a position below the weakened seam to the internal groove. The slots are provided to permit sufficient give or flexibility to facilitate snapping the closure over the container nozzle for closure purposes in a tamper-proof manner whereby the bottom extension of the closure cannot be removed from the container transfer bead once the closure has been applied over the nozzle.

It is therefore an object of the present invention to provide an improved tamperproof closure of the type set forth.

It is another object of the present invention to provide a novel tamperproof closure which comprises generally a closure having cylindrical sidewalls, a cylindrical bottom extension, a weakened seam defining the sidewalls from the bottom extension and a plurality of circularly spaced slots in the bottom extension to facilitate frictional engagement of the closure over a container nozzle in a manner and to prevent removal of the closure from the nozzle without breaking the closure along the weakened seam.

It is another object of the present invention to provide a novel tamperproof closure which is suitable for threaded or snap-on engagement over the nozzle of a container, the closure being provided with bottom groove means to frictionally engage circular transfer bead means on the nozzle and weakened seam means defining a bottom extension, whereby the bottom extension will always remain affixed to the container transfer bead means to provide a tamper-proof construction.

It is another object of the present invention to provide a novel tamperproof closure which employs operating components of different diameters, the part of lesser diameter overfitting the part of greater diameter whereby the parts cooperate to form a frictionally engaged, tamperproof construction.

It is another object of the present invention to provide a novel tamperproof closure that it inexpensive in manufacture, simple in design and reliable when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is an enlarged perspective view of a tamperproof closure in accordance with the present invention.

FIG. 2 is a sectional view through the closure showing the closure immediately prior to application upon the nozzle of a container.

FIG. 3 is a view similar to FIG. 2 showing the closure fully seated upon the nozzle of the container.

FIG. 4 is a view similar to FIG. 3 showing the closure broken along the weakened seam and with the severed top in exploded relationship.

FIG. 5 is an enlarged perspective view showing a modified tamperproof closure construction.

FIG. 6 is an enlarged perspective view showing another modification of a tamperproof closure.

FIG. 7 is a side elevational view of the closure of FIG. 6 in sealed engagement over the nozzle of a container.

FIG. 8 is a cross-sectional view of the embodiment of FIG. 7 showing the modified closure about to be applied over the nozzle of the container.

FIG. 9 is a cross-sectional view similar to FIG. 8 showing the modified closure fully seated upon the container nozzle.

FIG. 10 is a cross-sectional view similar to FIG. 8 showing a top portion of the closure in exploded relationship after removal from association with the nozzle of the container.

DESCRIPTION OF THE PREFERRED EMBODIMENT OF THE INVENTION

Although specific terms are used in the following description for the sake of clarity, these terms are intended to refer only to the particular structure of the invention selected for illustration in the drawings, and are not intended to define or limit the scope of the invention.

Referring now to the drawings, a tamperproof closure 10 is illustrated in FIG. 1 which is fabricated by molding or other known material forming technique from a flexible, resilient material having a relatively firm body such as polythylene plastic, polypropylene plastic or other suitable material. The closure 10 is designed for use with a container 12 having a nozzle 14 of relatively unyielding material such as glass, metal or suitable hard plastic.

The closure 10 is fabricated of unitary construction and includes a flat top 20 and integral, depending, circular side walls 22. A hollow, cylindrical bottom extension 30 forms a continuation of the sidewall 22 and is defined therefrom by a circular weakened seam 26'. The interior of the combination side wall 22 and bottom extension 30 is formed to provide a continuous internal thread 24 for threaded engagement over the external threads 16 provided in the container nozzle 14.

The closure internal threads 24 terminate downwardly in a bottom circular groove 32 for tamperproof closure purposes in the manner hereinafter more fully set forth. A plurality of longitudinally aligned, circularly spaced slots 28 are provided in the bottom extension 30 to facilitate closure application over the container nozzle 14 as hereinafter more fully set forth. All of the slots 28 are similar in configuration and extend radially entirely through the wall of the closure bottom extension 30. The slots extend in length from immediately below the weakened seam 26' to terminate in the upper portion of the bottom groove 32.

As seen in FIGS. 2 and 3, the container 12 is finished upwardly in usual manner in a restricted nozzle 14 of conventional configuration. The container nozzle construction comprises external threads 16 and a bottom, circular transfer bead 18 of known construction. The external thread 16 of the nozzle are designed to be threadedly engaged by the interior threads 24 of the closure 10 for sealing engagement of the closure over the nozzle. If desired, a suitable gasket or seal 44 may be interposed between the bottom wall 40 of the closure top 20 and the top 38 of the container nozzle 14 in well known manner.

In forming the parts comprising the invention, it is of utmost importance to form the outer diameter of the nozzle transfer bead 18 of dimensions slightly greater than the outer diameter of the closure groove 32. Accordingly, when the closure 10 is fully applied over the nozzle 14 as illustrated in FIG. 3 there will be a tight, frictional engagement between the closure bottom extension 30 and the bottom of the nozzle 14 due to the interengagement respectively of the nozzle transfer bead 18 and the bottom extension interior groove 32. In applying the closure 10 over the nozzle 14, and referring now to FIG. 2, it will be noted that as the closure 10 is rotated to threadedly engage the closure interior threads 24 upon the nozzle exterior threads 16 a certain amount of flexure or give must be provided in the closure bottom extension 30 to permit the closure bottom flange 34 to overfit the outer periphery of the transfer bead 18. This is particularly true since the diameter of the transfer bead 18 is formed to be larger than he diameter of the closure bottom groove 32. The plurality of circularly spaced slots 28 and the natural resiliency of the closure material itself provides this flexibility in the bottom extension 30 by opening or flexing sufficiently to allow the bottom flange 34 to slide past the transfer bead 18. Continued turning or threading the closure relative to the nozzle causes the circular groove 32 to overfit and frictionally engage the transfer bead 18. Due to the differences in diameter between the groove 32 and the transfer bead 18 as above discussed, when the closure is threadedly engaged upon the nozzle, the bottom extension 30 will always remain affixed on the transfer bead 18.

Once the closure bottom groove 32 is frictionally engaged over the nozzle transfer bead 18, it will be appreciated that a tamperproof arrangement has been provided and the closure bottom extension 32 cannot easily be removed from association with the nozzle at the transfer bead 18 thereof. When the container is opened, the closure will separate along the weakened seam 26' and the bottom extension 30 will remain tightly frictionally secured about the transfer bead 18.

Referring now to FIG. 4, when it is desired to open the container 12 to expose the interior contents thereof, the user must grasp the container 12 in one hand and the closure 10 at the sidewalls 22 thereof in the other and then turn the closure relative to the container 12 to threadedly disengage the parts. As above set forth, the bottom extension 30 is tightly, frictionally engaged upon the transfer bead 18 and so cannot rotate when the closure sidewalls 22 are rotated or unthreaded. Under such an arrangement, something must give and the weakened seam 26' is provided for this purpose.

The design of the closure 10 is so controlled that the closure will separate along the weakened seam 26' and break thereabout before sufficient turning forces can be generated to overcome the frictional engagement between the groove 32 and the transfer bead 18. In this manner, as illustrated in FIG. 4, when the container is opened, the closure top 20 and sidewall 22 will separate from the bottom extension 30, which bottom extension will then always remain affixed to the container nozzle at the transfer bead 18, thereby to always give physical evidence when the container has been opened. Once the closure has been broken along the weakened seam 26', the contents of the container 18 will then be available at the nozzle top 38 in usual manner. Sufficient threads 24 are provided within the interior of the closure sidewalls 22 below the top 20 to permit the sidewalls to again be threadedly engaged upon the upper portions of the nozzle threads 16 to reclose the container after use.

In the embodiment illustrated in FIG. 5, a modified closure 10' is illustrated having closure sidewalls 22' and a hollow cylindrical bottom extension 30' defined therefrom by a circular, weakened seam 26'. The closure 10' is interiorly provided with an interior thread 24' which threadedly terminates at the bottom internal groove 32' in the manner hereinbefore described when considering the embodiment of FIG. 1. A bottom circular flange 34' defines the bottom extent of the groove 32' in the same manner as the FIG. 1 embodiment. As illustrated, a plurality of circularly spaced, slanted slots 36 are formed in the bottom extension 30' in place of the longitudinally aligned slots 28 illustrated in FIG. 1. The slanted or angularly inclined slots 36 facilitate threaded engagement over the external threads 16 of a nozzle 14.

It will be appreciated that as the closure 10 or closure 10' is threadedly applied over the nozzle 14 of a container 12, the closure will be in compression and any required flexure to permit the bottom flange 34, 34' to slide over the container transfer bead 18 will be provided by resiliency of the closure material and the slots 28 or 36. Accordingly, there will be no tendency to break along the weakened seam 26' at the time of initial application. Once the bottom groove 32, 32' is securely frictionally engaged over the transfer bead 18, then the only way that the container can be opened will be to break the closure 10, 10' along the weakened seam 26'. This permanent breaking provides a tamperproof construction wherein there will always be easy visual indication when the container had been previously opened.

Referring now to the embodiment illustrated in FIGS. 6–10, another embodiment of a tamperproof closure 42 is illustrated of the so-called snap-on type. As best seen in FIG. 6, in this embodiment, the closure 42 is similarly formed with a closure top 20'' and integral sidewalls 22'' depending therefrom. A hollow cylindrical bottom extension 30'' extends from the sidewall 22'' and is defined therefrom by a weakened 26''. A plurality circularly spaced slots 28'' are similarly formed in the bottom extension 30'' and extend from the upper portion of the interior groove 32'' to just below the weakened seam 26''. A radially outwardly projecting pull-tab 50 extends from the outer periphery of the sidewall 22'' for container opening purposes. If desired, gasket or seal 44'' may be applied against the underside of the closure top 20''.

As best seen in FIGS. 8, 9 and 10, the container nozzle 14'' is formed of snap-on configuration and includes a medial snap-ring 46 which is intermediately positioned between the nozzle top 38'' and the nozzle transfer bead 18''. As illustrated, the interior periphery of the closure 42 is formed of complimentary configuration and includes a snap-groove 48 to cooperatively engage the snap ring 46. The bottom of the interior periphery of the bottom extension 30'' is provided with a circular groove 32'' of diameter smaller than the diameter of the transfer bead 18''.

As illustrated in FIG. 8, the closure 42 can be applied over the nozzle 14' by pressing the closure downwardly in the direction of the arrow 52 until the bottom flange 34'' flexes outwardly and over the outer periphery of the transfer bead 18''. This flexure is enhanced by the flexibility provided by the plurality of the longitudinally aligned slots 28″ as illustrated (or angular slots if used) to thereby allow the bottom extension 28″ to tightly, frictionally, engage over the transfer bead 18″.

When it is desired to open the container 12″, the closure 42 can be grasped at the tab 50 and pushed or pulled upwardly in the direction of the arrow 54 to impose shear forces upon the closure at the weakened seam 26″ thereof. In a manner similar to the construction previously described for the embodiment of FIGS. 1–5, the weakened seam 26″ is so designed that the closure will separate at the weakened seam before sufficient forces are imposed to break the frictional engagement between the bottom extension 30″ and the nozzle 14″ at the respective groove 32″ and transfer bead 18″ frictional engagement therebetween.

Again, in the embodiment illustrated in FIGS. 6–10, it will be appreciated that once the closure 42 has been removed from the container 12″ by breaking along the weakened seam 26″, it will then be impossible to hide the fact that the container had once been opened.

As illustrated in FIG. 10, an angular lower portion 56 of the snap groove 48 remains in association with the severed portion of the closure and this angular lower protion is designed to extend below the nozzle snap ring 46. Accordingly, after the container has been opened, the container can be reclosed by pushing the severed top portion of the closure downwardly upon the nozzle 14″ and engaging the closure angular portion 56 upon the nozzle 14″ below the snap ring 46.

Although the present invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. A tamperproof closure for securing to the nozzle of a container of the type having a nozzle provided with a medial snap ring and a lower, circular transfer bead comprising a circular top and cylindrical sidewalls depending therefrom, the sidewalls having an interior surface;

a bottom extension extending from the sidewalls, the bottom extension having an exterior cylindrical surface and an interior surface, the bottom extension being provided with an internal circular groove, the outer diameter of the groove being less than the outer diameter of the nozzle transfer bead, the groove of the bottom extension being adapted for frictional engagement over the transfer bead of the nozzle;

a circular weakened seam defining the bottom extension from the said cylindrical sidewalls; and a snap groove formed in the interior of the closure, the snap groove being formed partially in the interior surface of the sidewalls and in the interior surface of the bottom extension, the snap groove of the closure being adapted for engagement upon the snap ring of the nozzle, whereby the strength of the frictional engagement between the closure circular groove and the nozzle transfer bead is greater than the strength of the closure at the said weakened seam so that when the closure is to be removed from the nozzle for container opening purposes, the closure will separate along the weakened seam and the bottom extension will remain affixed to the transfer bead of the nozzle.

2. The tamperproof closure of claim 1 and a plurality of slots formed in the closure.

3. The tamperproof closure of claim 2 wherein the slots are formed in the said bottom extension.

4. The tamperproof closure of claim 3 wherein the slots are circularly spaced about the periphery of the bottom extension.

5. The tamperproof closure of claim 4 wherein the slots extend in length from a position below the weakened seam and into the circular groove.

6. The tamperproof closure of claim 3 wherein at least some of the slots are vertically oriented.

7. The tamperproof closure of claim 1 wherein the said sidewall interior surface includes an angularly inclined bottom portion defined between the snap groove and the weakened seam, the angularly inclined bottom portion being adapted to permit the sidewall to be engaged below the nozzle snap ring after the closure has been severed along the weakened seam.

* * * * *